United States Patent [19]

Haug et al.

[11] Patent Number: 5,057,653

[45] Date of Patent: Oct. 15, 1991

[54] HIGH-VOLTAGE DISTRIBUTOR FOR IGNITION SYSTEMS OF INTERNAL COMBUSTION ENGINES

[75] Inventors: Heinz Haug, Korntal-Münchingen; Matthias Perner, Stuttgart, both of Fed. Rep. of Germany

[73] Assignee: Robert Bosch GmbH, Stuttgart, Fed. Rep. of Germany

[21] Appl. No.: 459,701

[22] PCT Filed: May 20, 1989

[86] PCT No.: PCT/DE89/00318

§ 371 Date: Jan. 10, 1990

§ 102(e) Date: Jan. 10, 1990

[87] PCT Pub. No.: WO90/00228

PCT Pub. Date: Jan. 11, 1990

[30] Foreign Application Priority Data

Jun. 30, 1988 [DE] Fed. Rep. of Germany ..... 3821966

[51] Int. Cl.[5] ..... H01H 19/00; F02P 7/02; H01R 39/60

[52] U.S. Cl. ..... 200/19 R; 200/19 DR

[58] Field of Search ..... 200/19 R, 19 DR, 19 DC

[56] References Cited

U.S. PATENT DOCUMENTS

| | | | |
|---|---|---|---|
| 1,370,077 | 3/1921 | Whisler | 200/19 A |
| 2,174,081 | 9/1939 | Fitzsimmons | 200/19 DC |
| 3,951,508 | 4/1976 | Farrer et al. | 200/19 DC X |
| 4,023,546 | 5/1977 | Kawakami | 200/19 DR X |
| 4,384,178 | 5/1983 | Nagai et al. | 200/19 DC X |
| 4,562,317 | 12/1985 | Gerber et al. | 200/19 DR |
| 4,575,593 | 3/1986 | Welker et al. | 200/19 DR |
| 4,632,077 | 12/1986 | Novak et al. | 200/19 R X |

FOREIGN PATENT DOCUMENTS

| | | | |
|---|---|---|---|
| 212030 | 4/1987 | European Pat. Off. . | |
| 686731 | 1/1940 | Fed. Rep. of Germany . | |
| 3246903 | 10/1983 | Fed. Rep. of Germany | 200/19 DR |
| 1198206 | 12/1959 | France . | |
| 693383 | 7/1953 | United Kingdom . | |

*Primary Examiner*—J. R. Scott

*Attorney, Agent, or Firm*—Michael J. Striker

[57] ABSTRACT

A high-voltage distributor for ignition systems of internal combustion engines has a distributor cap of insulating material with a center electrode and several fixed electrodes which is placed on a distributor housing containing a distributor rotor, or cylinder head. The distributor rotor rotating synchronously with the camshaft of the internal combustion engine establishes an electric connection between the center electrode and the fixed electrodes via a rotor electrode. To establish contact with the distributor rotor, the center electrode has an axially displaceable carbon pin which rests in a cylindrical guide in the distributor cap and rests against the rotor electrode under the action of a compression spring. To avoid damage to the carbon pin when the distributor cap is laterally pushed onto the housing, the guide is widened in the form of a funnel at the carbon pin emergence end so that the carbon pin, which protrudes far out of the guide in the unloaded state, can be laterally deflected and is not exposed to any blending stress leading to fracture.

4 Claims, 1 Drawing Sheet

HIGH-VOLTAGE DISTRIBUTOR FOR IGNITION SYSTEMS OF INTERNAL COMBUSTION ENGINES

BACKGROUND OF THE INVENTION

The invention relates to a high-voltage distributor for ignition systems of internal combustion engines.

A high-voltage distributor is known comprising a distributor cap of insulating material with a center electrode and several fixed electrodes and a distributor rotor with a rotor electrode which rotates synchronously with a cam shaft of the associated internal combustion engine and establishes an electrical connection one-after-the-other between the center electrode and each of the fixed electrodes. The center electrode which is coaxial with respect to the axis of rotation of the distributor rotor has an axially displaceable pin resting in a cylindrical guide in the distributor cap which rests on a rotor electrode in the distributor rotor under the action of a precompressed compression spring to establish an electric contact with the distributor rotor.

For reasons of space available during the assembly of such high-voltage distributors, the distributor cap must be pushed laterally, that is to say radially with respect to the center electrode, onto the distributor housing containing the distributor rotor or onto the cylinder head so that it can then be connected to the distributor housing or the cylinder head in the centered end position, in which the pin, which in most cases consists of carbon or carbon-containing material and will subsequently be called carbon, is then placed onto the rotor electrode and is partially inserted into the distributor cap against the action of the compression spring. The carbon, which protrudes far out of the distributor cap in the unloaded state due to the compression-spring loading, can be radially loaded by rotor parts or engine parts or the distributor housing coming into contact with the carbon during the lateral insertion of the distributor cap, even a slight bending stress leading to fracture of the carbon.

SUMMARY OF THE INVENTION

It is an object of the present invention to provide a high-voltage distributor of the above-described kind in which fracture of the carbon during assembly is avoided.

According to our invention the cylindrical guide is widened in the vicinity of the pin emergence opening in the distributor opening to form a funnel-shaped widening.

By comparison, the high-voltage distributor according to the invention, having the characterizing features of claim 1, has the advantage that due to the funnel-shaped widening of the cylindrical carbon guide near the opening where the carbon emerges from the carbon guide, a flexible flexurally elastic mounting of the carbon in the distributor cap is achieved during the assembly. The carbon, which is pushed out into the widening with its compression-spring-side end in the unloaded state can be laterally deflected during the lateral insertion of the distributor cap and, as a result, is not exposed to any bending stress. After assembly, the carbon, which has been pushed back again deeply into the carbon guide, is mainly carried in the cylindrical part of the guide.

If, in accordance with an advantageous embodiment of the invention, the rotor electrode is surrounded by a guide edge in the support area of the carbon, an additional guidance of the carbon is achieved and a protection against any lateral drifting away of the carbon in the operating condition is created. In this case, the cylindrical guide can have a loose fit for the carbon. The lateral guide edge in this arrangement can be integrally provided at a contact plate mounted on the rotor electrode or molded onto the distributor rotor.

DETAILED DESCRIPTION OF THE DRAWING

Figure 1:
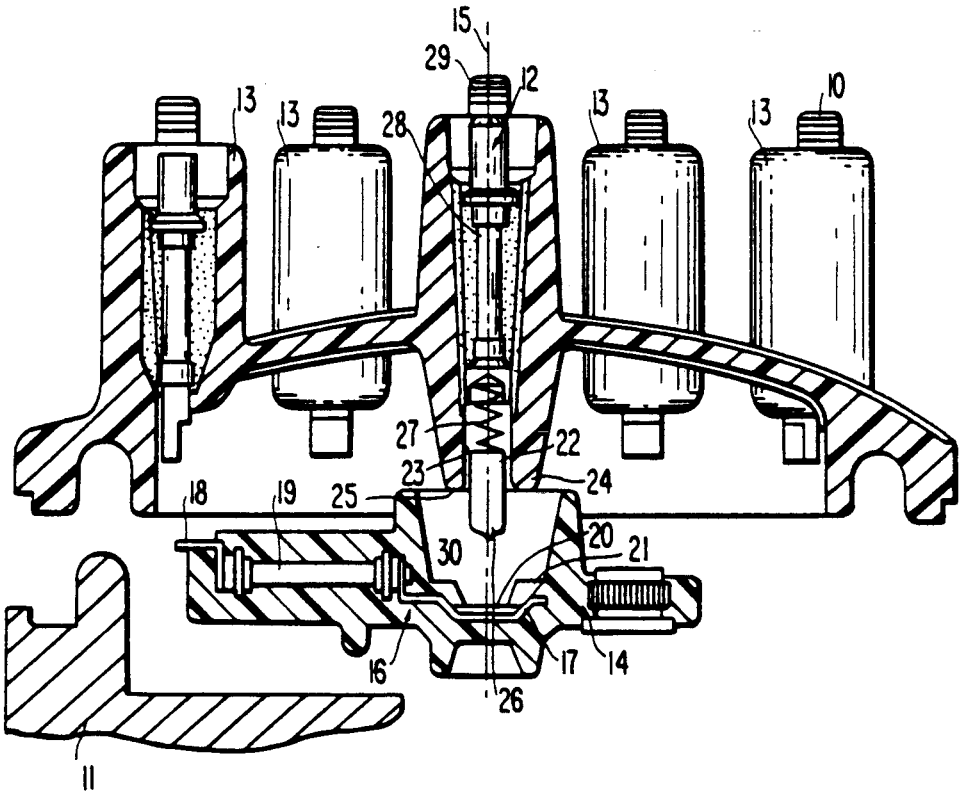
Figure 2:
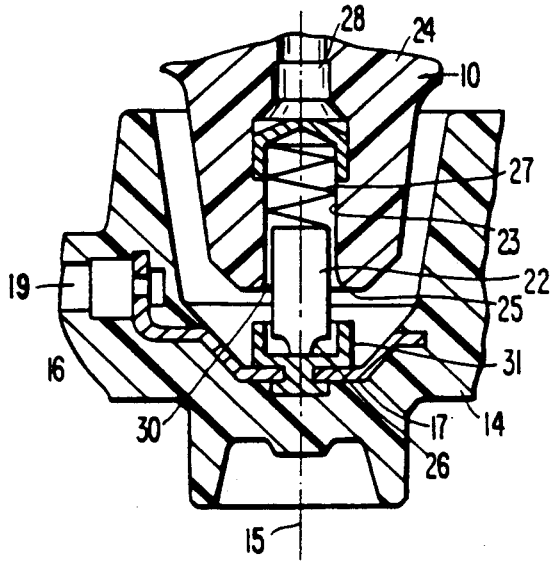

In the description following, the invention is explained in greater detail with reference to illustrative embodiments shown in the drawing, in which:

FIG. 1 is a longitudinal cross sectional view of a high-voltage distributor according to our invention, and FIG. 2 is a detailed longitudinal cross sectional view of another embodiment of a high-voltage distributor according to our invention.

DETAILED DESCRIPTION OF THE INVENTION

The high-voltage distributor, shown in section in FIG. 1, for an ignition system of a multi-cylinder internal combustion engine has a distributor cap 10 of insulating material which covers a distributor housing 11 or a cylinder head, of which only a section is shown. The distributor cap 10 carries a center centre electrode 12 and a number of fixed electrodes 13 which corresponds to the number of cylinders of the internal combustion engine and which are arranged at equal spacing from one another on a circular track which is concentric to the center electrode 12.

In the distributor housing 11 or cylinder head, a distributor rotor 14 is rotatably arranged which is connected fixed against rotation to an associated driveshaft, not shown here, or to the camshaft of the internal combustion engine. The distributor rotor 14 rotating around an axis of rotation 15 establishes an electric connection between the center electrode 12, the longitudinal axis 30 of which is essentially in line with the rotational axis 15, and one of the fixed electrodes 13 in each case by means of a rotor electrode 16 during its rotation. For this purpose, the rotor electrode 16 has a center part 17 which is arranged in the area of the axis of rotation 15 and transversely with respect to the latter and a distributor finger 18 which rotates underneath the fixed electrodes 13 and successively comes into contact with the latter. Center part 17 and distributor finger 18 are electrically conductively connected to one another via a radio-frequency interference suppressing resistor 19. A metallic contact plate 20, for example of brass, rests on the center part 17 of the rotor electrode 16. A guide edge 21, which expands in the form of a funnel from the contact plate 20 and consists of plastic material identical to that of the distributor rotor 14 is molded on around the contact plate 20.

To establish the electric contact to the center electrode 12, the rotor electrode 16 has a carbon 22 which is axially displaceably guided in a cylindrical guide 23 which is coaxial with the longitudinal axis 15 of the center electrode 12. The guide cylinder 23 is arranged in a dome-like projection 24 of the distributor cap 10 which protrudes from the cap wall towards the distributor rotor 14 and is preferably rotationally symmetrically constructed. The guide cylinder 23 is widened in the form of a funnel at the front of the projection 24 in the area of the emergence opening 25 which is achieved by providing a rounding radius R at the inner annular edge of the emergence opening 25 (FIG. 2). The funnel-shaped widening is identified by 30. The front face of the carbon pin 22 protruding from, the emergence opening 25 is provided with a convex portion 26 by means of which the carbon pin 22 rests against the contact plate 20 in the distributor rotor 14 under the action of a compression spring 27 which engages the rear of the carbon pin 22 in a completely assembled distributor cap 10 (FIG. 2). The compression spring 27 is supported against a contact pin 28 which establishes the electric connection to a distributor connection 29 for the center electrode 12. The contact pin 28 is hollowed out in the form of a cap at its compression-spring-side front end and thus forms a certain guide for the compression spring 27.

During the assembly of the high-voltage distributor, the distributor cap 10 must be inserted laterally, that is to say radially with respect to the axis of rotation 15 of the distributor rotor 14, for installation reasons. The carbon pin 22, from which the load of the distributor rotor 14 is removed, protrudes far out of the cylindrical guide 23 under the action of the compression spring 27, during which its compression-spring-side end passes into the funnel-shaped widening 30 of the guide cylinder 23. If then a part, for example an engine part, a rotor part or the distributor housing 11, comes into contact with the carbon pin 22 during the insertion of the distributor cap 10, the carbon pin can be laterally deflected and is thus not exposed to any bending stress which would ultimately lead to an unwanted fracture or cracking of the carbon pin 22. FIG. 1 shows the distributor cap 10 and the distributor housing 11 or the cylinder head with distributor rotor 14 in a not yet completely assembled state. However, the distributor cap 10 is already pushed onto the distributor housing 11 or the cylinder head to such an extent that the two parts are coaxially aligned with one another. In this position, the distributor cap only needs to be lowered in the direction of the axis of rotation 15 and placed onto the distributor housing 11 or the cylinder head. During this movement, the carbon pin 22 is placed against the contact plate 20 in the distributor rotor 14 and pushed back into the cylindrical guide 23 against the action of the compression spring 27.

The further illustrative embodiment of a high-voltage distributor, shown in section only in the area of the center electrode 12 in FIG. 2, only differs from the high-voltage distributor described above in that it is not a contact plate 20 with molded-on plastic guide edge 21 which is provided in the support area of the carbon pin 22 at the rotor electrode 16 but a cup-shaped guide cap 31 of electrically conductive material such as brass which is connected to the center part 17 of the rotor electrode 16. For the rest, this high-voltage distributor corresponds to that described with reference to FIG. 1 so that identical components are provided with identical reference symbols. The high-voltage distributor according to FIG. 2 is shown in its completely assembled position in which the compression spring 27 presses the carbon pin 22 against the inner bottom of the guide cap 31. Like the guide edge 21 in FIG. 1, the guide cap 31 prevents a lateral drifting away of the carbon pin 22 during operation.

It will be understood that each of the elements described above, or two or more together, may also find a useful application in other types of structures differing from the types described above.

While the invention has been illustrated and described as embodied in a high-voltage distributor for an ignition system of an internal combustion system, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed is new and desired to be protected by Letters Patent is set forth in the appended claims.

We claim:

1. A high-voltage distributor for an ignition system of an internal combustion engine having a camshaft, said high-voltage distributor comprising a distributor cap formed of insulating material; a center electrode supported in said distributor cap and having a longitudinal axis and a substantially axially displaceable pin; a plurality of circumferentially equidistantly spaced secondary electrodes concentric with said center electrode and fixedly supported in said distributor cap; a distributor rotor having an axis of rotation substantially coaxial with the longitudinal axis of said center electrode and a rotor electrode, said distributor rotor rotating synchronously with the camshaft of the internal combustion engine for establishing a consecutive electrical connection between said center electrode and each of said secondary electrodes by said rotor electrode; a cylindrical guide supported in said distributor cap for guiding said substantially axially displaceable pin upon axial displacement thereof into engagement with said rotor electrode; and a compression spring supported in said cylindrical guide for biasing said substantially axially displaceable pin into engagement with said rotor electrode; said cylindrical guide having a pin emergence opening and a funnel-shaped widening in an area of said pin emergence opening for enabling lateral displacement of said substantially axially displaceable pin when it is subjected to bending forces acting thereon, and said rotor electrode having guide edges in a contact region of said rotor electrode with said substantially axially displaceable pin to provide for a substantially axial displacement of said pin in the contact region.

2. A high voltage distributor as defined in claim 1, wherein said rotor electrode includes a contact plate for supporting said pin, said guide edges being provided around said contact plate and being formed integrally therewith.

3. A high voltage distributor as defined in claim 2, wherein said guide edges are of a plastic material.

4. A high voltage distributor as defined in claim 1, wherein said rotor electrode comprises a cup-shaped guide cap defining said guide edges, said substantially axially displaceable pin resting on said guide cap.

* * * * *